US006993916B2

(12) United States Patent
Johnson et al.

(10) Patent No.: US 6,993,916 B2
(45) Date of Patent: Feb. 7, 2006

(54) BURNER TUBE AND METHOD FOR MIXING AIR AND GAS IN A GAS TURBINE ENGINE

(75) Inventors: Thomas Edward Johnson, Greer, SC (US); Stanley Kevin Widener, Greenville, SC (US); Kevin Weston McMahan, Greer, SC (US)

(73) Assignee: General Electric Company, Schenectady, NY (US)

( * ) Notice: Subject to any disclaimer, the term of this patent is extended or adjusted under 35 U.S.C. 154(b) by 112 days.

(21) Appl. No.: 10/862,427

(22) Filed: Jun. 8, 2004

(65) Prior Publication Data

US 2005/0268618 A1 Dec. 8, 2005

(51) Int. Cl.
*F02C 7/22* (2006.01)
*F02C 7/26* (2006.01)

(52) U.S. Cl. ..... 60/776; 60/748; 60/737; 239/405

(58) Field of Classification Search ..... 60/772, 60/776, 737, 740, 739, 742, 746–748; 239/399, 239/402–405, 461, 463, 166; 431/8, 181–184, 431/187, 284, 285, 287
See application file for complete search history.

(56) References Cited

U.S. PATENT DOCUMENTS 3,808,803 A * 5/1974 Salvi ..... 60/737
3,915,387 A * 10/1975 Caruel et al. ..... 239/400
3,917,173 A * 11/1975 Singh ..... 239/400
3,972,182 A * 8/1976 Salvi ..... 60/743
5,165,241 A 11/1992 Joshi et al.
5,224,333 A * 7/1993 Bretz et al. ..... 60/740
5,251,447 A 10/1993 Joshi et al.
5,259,184 A 11/1993 Borkowicz et al.
5,351,477 A 10/1994 Joshi et al.
5,590,529 A 1/1997 Joshi et al.
5,613,363 A * 3/1997 Joshi et al. ..... 60/737
5,638,682 A 6/1997 Joshi et al.
5,647,215 A * 7/1997 Sharifi et al. ..... 60/737
5,647,538 A * 7/1997 Richardson ..... 239/405
5,675,971 A * 10/1997 Angel et al. ..... 60/746
5,680,766 A 10/1997 Joshi et al.
5,722,230 A 3/1998 Cohen et al.
5,729,968 A 3/1998 Cohen et al.
5,822,992 A 10/1998 Dean
5,901,548 A * 5/1999 Coffinberry ..... 60/776

(Continued)

OTHER PUBLICATIONS

R.M. Washam; Dry Low $NO_x$ Combustion System For Utility Gas Turbine; The American Society of Mechanical Engineers; 83 JPGC-GT-13; pp. 1-5; no date.

*Primary Examiner*—William H. Rodriguez
(74) *Attorney, Agent, or Firm*—Nixon & Vanderhye PC

(57) ABSTRACT

A hybrid structure that combines characteristics of the DACRS and Swozzle burners to provide the high mixing ability of an axial flowing counter rotating vane swirler with good dynamic flame stability characteristics of a bluff center body.

22 Claims, 6 Drawing Sheets

U.S. PATENT DOCUMENTS 5,916,142 A * 6/1999 Snyder et al. ..... 60/748
5,943,866 A 8/1999 Lovett et al.
5,983,642 A * 11/1999 Parker et al. ..... 60/737
6,112,870 A * 9/2000 Fukumoto ..... 192/3.58
6,141,967 A * 11/2000 Angel et al. ..... 60/737
6,269,646 B1 8/2001 Lovett et al.
6,363,726 B1 * 4/2002 Durbin et al. ..... 60/748
6,415,594 B1 * 7/2002 Durbin et al. ..... 60/772
6,427,435 B1 8/2002 Patterson et al.
6,438,961 B2 8/2002 Tuthill et al.
6,453,660 B1 * 9/2002 Johnson et al. ..... 60/39.821
6,460,344 B1 * 10/2002 Steinthorsson et al. ..... 60/776
6,474,569 B1 * 11/2002 Brundish et al. ..... 239/406
6,546,733 B2 4/2003 North et al.
6,609,377 B2 8/2003 Durbin et al.
6,708,498 B2 3/2004 Stickles et al.
2004/0079085 A1 * 4/2004 Mancini et al. ..... 60/776
2005/0039456 A1 * 2/2005 Hayashi ..... 60/737

* cited by examiner

BURNER TUBE AND METHOD FOR MIXING AIR AND GAS IN A GAS TURBINE ENGINE

BACKGROUND OF THE INVENTION

The present invention relates to heavy duty industrial gas turbines and, in particular, to a burner for a gas turbine including a fuel/air premixer and structure for stabilizing pre-mixed burning gas in a gas turbine engine combustor.

Gas turbine manufacturers are regularly involved in research and engineering programs to produce new gas turbines that will operate at high efficiency without producing undesirable air polluting emissions. The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. The rate of chemical reactions forming oxides of nitrogen (NOx) is an exponential function of temperature. If the temperature of the combustion chamber hot gas is controlled to a sufficiently low level, thermal NOx will not be produced.

One preferred method of controlling the temperature of the reaction zone of a combustor below the level at which thermal NOx is formed is to premix fuel and air to a lean mixture prior to combustion. The thermal mass of the excess air present in the reaction zone of a lean premixed combustor absorbs heat and reduces the temperature rise of the products of combustion to a level where thermal NOx is not formed.

There are several problems associated with dry low emissions combustors operating with lean premixing of fuel and air in which flammable mixtures of fuel and air exist within the premixing section of the combustor, which is external to the reaction zone of the combustor. There is a tendency for combustion to occur within the premixing section due to flashback, which occurs when flame propagates from the combustor reaction zone into the premixing section, or autoignition, which occurs when the dwell time and temperature for the fuel/air mixture in the premixing section are sufficient for combustion to be initiated without an igniter. The consequences of combustion in the premixing section are degradation of emissions performance and/or overheating and damage to the premixing section, which is typically not designed to withstand the heat of combustion. Therefore, a problem to be solved is to prevent flashback or autoignition resulting in combustion within the premixer.

In addition, the mixture of fuel and air exiting the premixer and entering the reaction zone of the combustor must be very uniform to achieve the desired emissions performance. If regions in the flow field exist where fuel/air mixture strength is significantly richer than average, the products of combustion in these regions will reach a higher temperature than average, and thermal NOx will be formed. This can result in failure to meet NOx emissions objectives depending upon the combination of temperature and residence time. If regions in the flow field exist where the fuel/air mixture strength is significantly leaner than average, then quenching may occur with failure to oxidize hydrocarbons and/or carbon monoxide to equilibrium levels. This can result in failure to meet carbon monoxide (CO) and/or unburned hydrocarbon (UHC) emissions objectives. Thus, another problem to be solved is to produce a fuel/air mixture strength distribution, exiting the premixer, which is sufficiently uniform to meet emissions performance objectives.

Still further, in order to meet the emissions performance objectives imposed upon the gas turbine in many applications, it is necessary to reduce the fuel/air mixture strength to a level that is close to the lean flammability limit for most hydrocarbon fuels. This results in a reduction in flame propagation speed as well as emissions. As a consequence, lean premixing combustors tend to be less stable than more conventional diffusion flame combustors, and high level combustion driven dynamic pressure fluctuation (dynamics) often results. Dynamics can have adverse consequences such as combustor and turbine hardware damage due to wear or fatigue, flashback or blow out. Thus, yet another problem to be solved is to control the combustion dynamics to an acceptably low level.

Lean, premixing fuel injectors for emissions abatement are in common use throughout the industry, having been reduced to practice in heavy duty industrial gas turbines for more than two decades. A representative example of such a device is described in U.S. Pat. No. 5,259,184, the disclosure of which is incorporated herein by this reference. Such devices have achieved great progress in the area of gas turbine exhaust emissions abatement. Reduction of oxides of nitrogen, NOx, emissions by an order of magnitude or more relative to the diffusion flame burners of the prior art have been achieved without the use of diluent injection such as steam or water.

As noted above, however, these gains in emissions performance have been made at the risk of incurring several problems. In particular, flashback and flame holding within the premixing section of the device result in degradation of emissions performance and/or hardware damage due to overheating. In addition, increased levels of combustion driven dynamic pressure activity results in a reduction in the useful life of combustion system parts and/or other parts of the gas turbine due to wear or high cycle fatigue failures. Still further, gas turbine operational complexity is increased and/or operating restrictions on the gas turbine are necessary in order to avoid conditions leading to high-level dynamic pressure activity, flashback, or blow out.

In addition to these problems, conventional lean premixed combustors have not achieved maximum emission reductions possible with perfectly uniform premixing of fuel and air.

Dual Annular Counter Rotating Swirler (DACRS) type fuel injector swirlers, representative examples of which are described in U.S. Pat. Nos. 5,165,241, 5,251,447, 5,351,477, 5,590,529, 5,638,682, 5,680,766, the disclosures of which are incorporated herein by this reference, are known to have very good mixing characteristics due to their high fluid shear and turbulence. Referring to the schematic representation in FIG. 1, a DACRS type burner 10 is composed of a converging center body 12 and a counter rotating vane pack 14 defining a radially inner passage 16 and a radially outer passage 18 with respect to the axis 20 of the center body, co-axial passages each having swirler vanes. The nozzle structure is supported by an outer diameter support stem 22 containing a fuel manifold 24 for feeding fuel to the vanes of the outer passage 18.

While DACRS type fuel injector swirlers are known to have very good mixing characteristics, these swirlers do not produce a strong recirculating flow at the centerline and hence frequently require additional injection of non-premixed fuel to fully stabilize the flame. This non-premixed fuel increases the NOx emissions above the level that could be attained were the fuel and air fully premixed.

Swozzle type burners, a representative example of which is described in U.S. Pat. No. 6,438,961, the disclosure of which is incorporated herein by this reference, employ a cylindrical center body which extends down the center line of the burner. The end of this center body provides a bluff body, forming in its wake a strong recirculation zone to which the flame anchors. This type of burner architecture is known to have good inherent flame stabilization.

Referring to FIG. 2, an example of a swozzle type burner is schematically depicted. Air enters the burner 42 at 40, from a high pressure plenum, which surrounds the assembly, except the discharge end 44 which enters the combustor reaction zone.

After passing through the inlet 40, the air enters the swirler or 'swozzle' assembly 50. The swozzle assembly includes a hub 52 (e.g., the center body) and a shroud 54 connected by a series of air foil shaped turning vanes 56 which impart swirl to the combustion air passing through the premixer. Each turning vane 56 includes gas fuel supply passage(s) 58 through the core of the air foil. These fuel passages distribute gas fuel to gas fuel injection holes (not shown) which penetrate the wall of the air foil. Gas fuel enters the swozzle assembly through inlet port(s) and annular passage(s) 60, which feed the turning vane passages 58. The gas fuel begins mixing with combustion air in the swozzle assembly 62, and fuel/air mixing is completed in the annular passage, which is formed by a center body extension 64 and a swozzle shroud extension 66. After exiting the annular passage, the fuel/air mixture enters the combustor reaction zone where combustion takes place.

The DACRS and swozzle type burners are both well-established burner technologies. That is not to say, however, that these burners cannot be improved upon. Indeed, as noted above, the DACRS type burners do not typically provide good premixed flame stabilization. Swozzle type burners, on the other hand, do not typically achieve fully uniform premixing of fuel and air.

BRIEF DESCRIPTION OF THE INVENTION

The invention provides a unique combination of burner concepts to include a dual, counter rotating, axial flowing swirler so as to exhibit very good mixing characteristics, with a cylindrical bluff center body to provide good flame stabilization.

Thus, the invention may be embodied in a burner for use in a combustion system of an industrial gas turbine, the burner comprising: an outer peripheral wall; a burner center body coaxially disposed within said outer wall; a fuel/air premixer including an air inlet, at least one fuel inlet, and a splitter ring, the splitter ring defining a first, radially inner passage, with respect to the axis of the center body, with the center body and a second, radially outer passage with the outer wall, the first and second passages each having air flow turning vanes which impart swirl to the combustion air passing through the premixer, said vanes connected respectively to said center body and said splitter ring and to said splitter ring and said outer wall; and a gas fuel flow passage defined within said center body and extending at least part circumferentially thereof, for conducting gas fuel to said fuel/air premixer.

The invention may also be embodied in a burner for use in a combustion system of an industrial gas turbine, the burner comprising: an outer peripheral wall; a burner center body coaxially disposed within said outer wall; a fuel/air premixer including an air inlet, at least one fuel inlet, and a splitter ring, the splitter ring defining a first, radially inner passage, with respect to the axis of the center body, with the center body and a second, radially outer passage with the outer wall, the first and second passages each having air flow turning vanes which impart swirl to the combustion air passing through the premixer, said vanes connected respectively to said center body and said splitter ring and to said splitter ring and said outer wall; an annular mixing passage defined between said outer wall and said center body, downstream of the turning vanes, said outer wall extending generally in parallel to said center body and in parallel to said axis of said center body, so that said mixing passage has a substantially constant inner and outer diameter along the length of the center body.

The invention may further be embodied in a method of premixing fuel and air in a burner for a combustion system of a gas turbine, the burner including an outer peripheral wall; a burner center body coaxially disposed within said outer wall; a fuel/air premixer including an air inlet, at least one fuel inlet, and a splitter ring, the splitter ring defining a first, radially inner passage, with respect to the axis of the center body, with the center body and a second, radially outer passage with the outer wall, the first and second passages each having air flow turning vanes which impart swirl to the combustion air passing through the premixer, said vanes connected respectively to said center body and said splitter ring and to said splitter ring and said outer wall, at least some of said vanes comprising an internal fuel flow passage, the fuel inlet introducing fuel into said internal fuel flow passages; and a gas fuel flow passage defined within said center body and extending at least part circumferentially thereof, for conducting gas fuel to said fuel/air premixer; the method comprising: (a) controlling a radial and circumferential distribution of incoming air upstream of the fuel inlet; (b) flowing said incoming air into said first and second passages of said swirler assembly; (b) imparting swirl to the incoming air with said turning vanes; and (c) mixing fuel and air into a uniform mixture downstream of said turning vanes, for injection into a combustor reaction zone of the burner.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

As mentioned above, DACRS type fuel injector swirlers are known to have very good mixing characteristics and the swozzle burner architecture is known to have good inherent flame stabilization. The invention is a hybrid structure that adopts features of the DACRS and Swozzle burners to provide the high mixing ability of an axial flowing counter rotating vane swirler with the good dynamic stability characteristics of a bluff center body.

Figure 1:
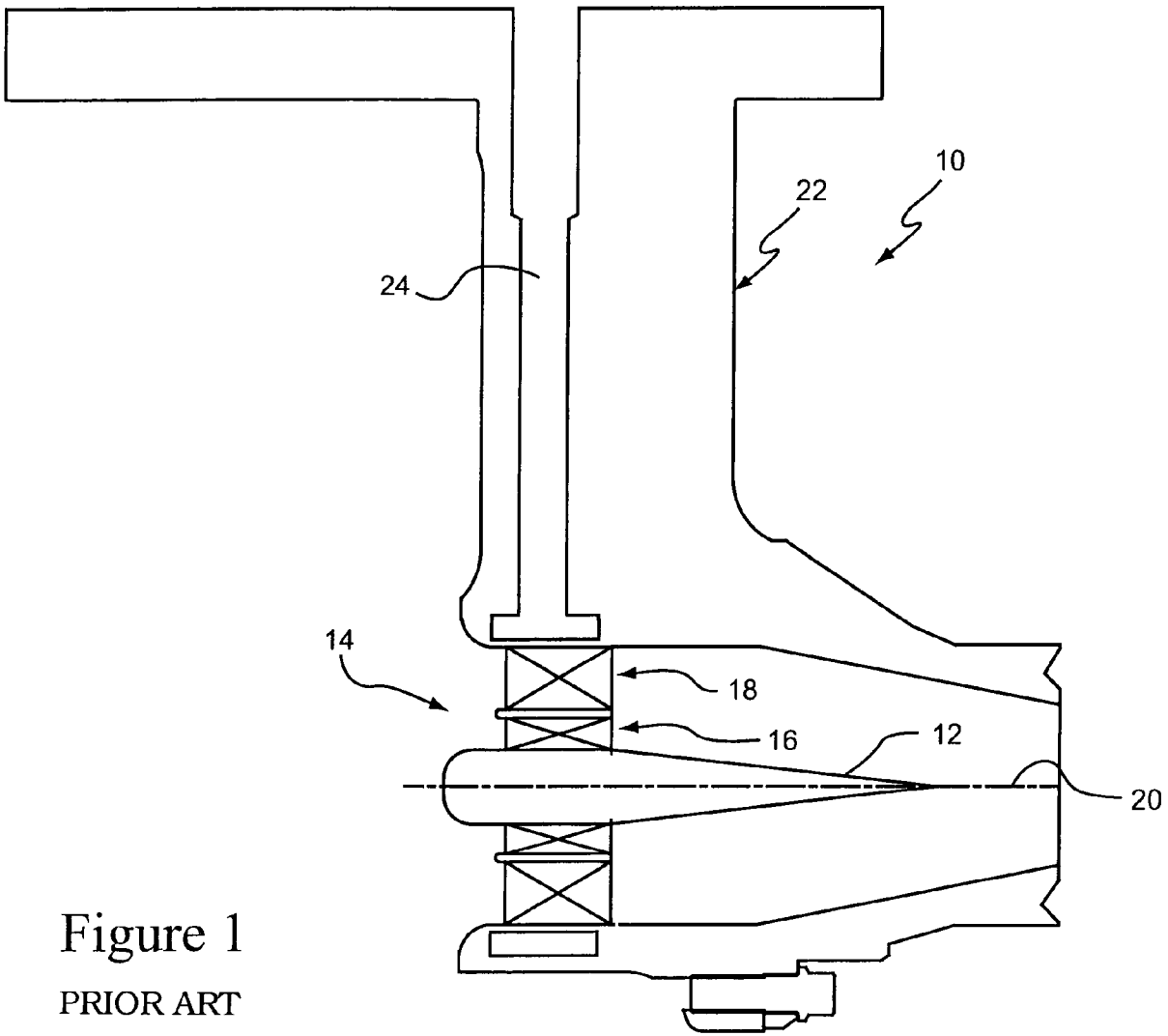
Figure 1 PRIOR ART
FIG. 1 is a schematic illustration of a conventional DACRS type burner.
Figure 2:
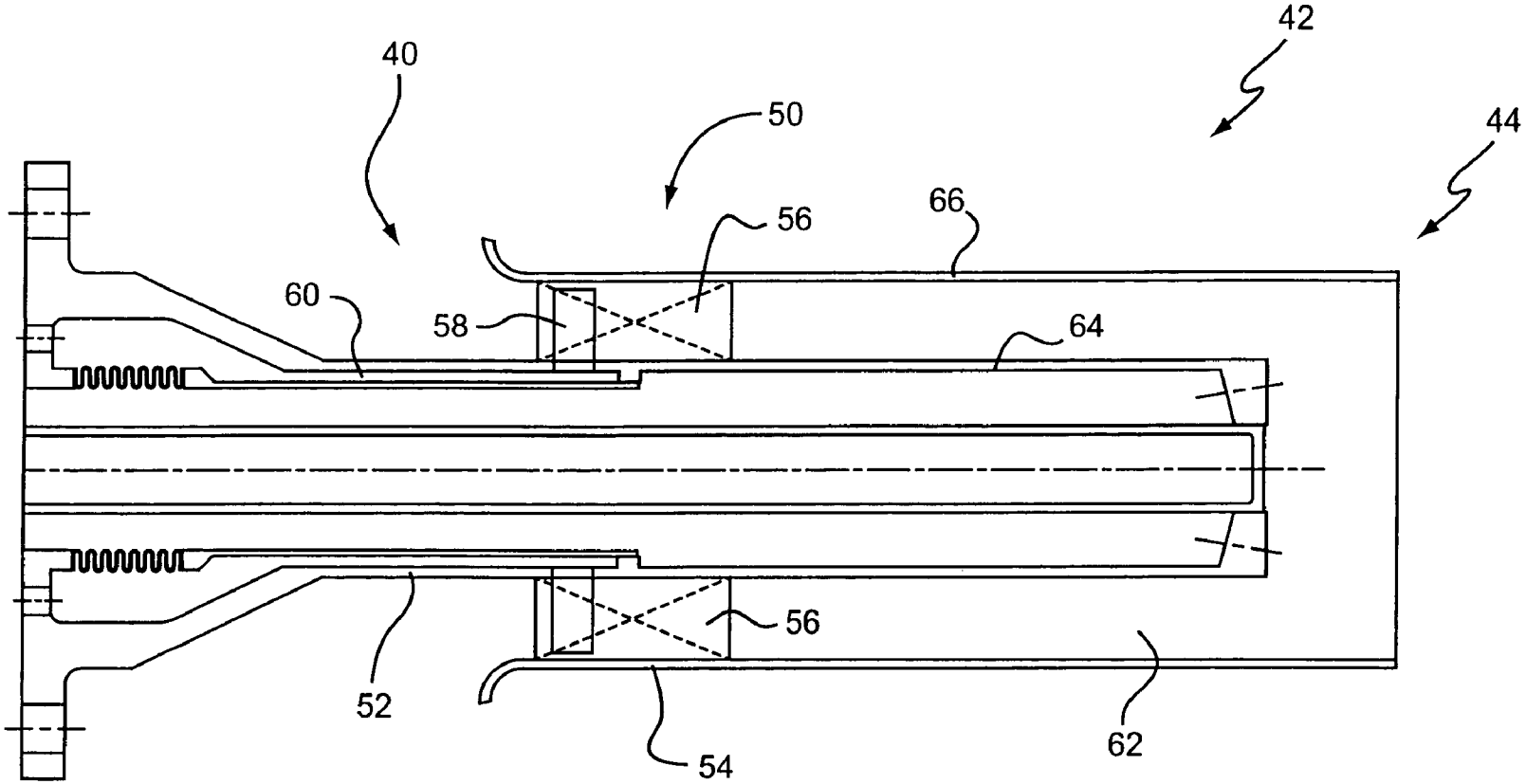
Figure 2 PRIOR ART
FIG. 2 is a schematic cross-sectional view of a conventional Swozzle type burner.
Figure 3:
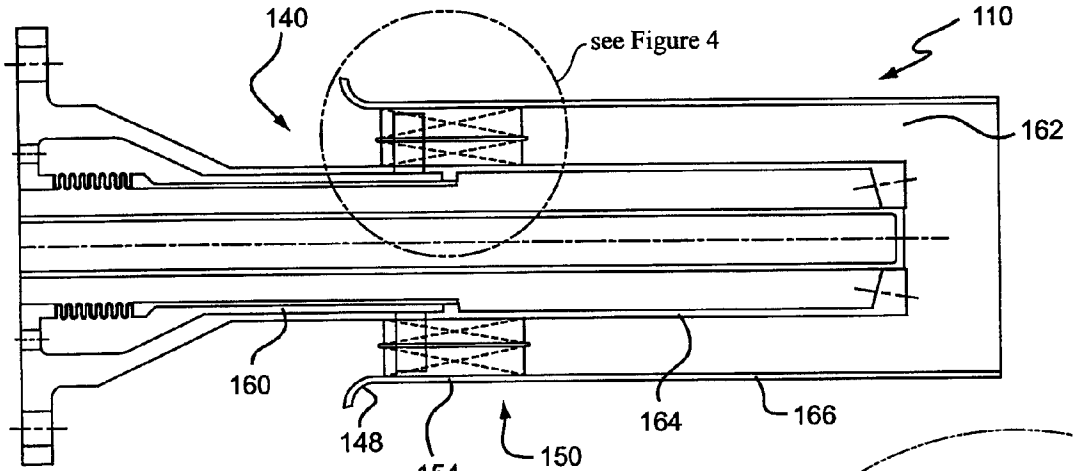
FIG. 3 is a schematic cross-sectional view of a burner embodying the invention.

FIG. 3 is a cross-section through a burner 110 embodying the invention, said burner substantially corresponding to a conventional Swozzle type burner as shown in FIG. 2 except for the structure of the swirler shown in the detail of FIG. 4 and in the perspective view of FIG. 5, or alternately FIG. 6, as described below. In practice, an atomized liquid fuel nozzle may be installed in the center of the burner assembly to provide dual fuel capability. However, the liquid fuel assembly, forming no part of this invention, has been omitted from the illustrations for clarity.

Air 140 enters the burner from a high pressure flow (not illustrated in detail) which surrounds the entire assembly except the discharge end, which enters the combustor reaction zone. Typically the air for combustion will enter the premixer via an inlet flow conditioner (not shown). As is conventional, to eliminate low velocity regions near the shroud wall at the inlet to the swirler, a bell-mouth shaped transition 148 is used between the inlet flow conditioner (not shown) and the swirler 150. The swirler assembly includes a hub 152, a splitter ring or vane 153 and a shroud 154 (omitted from FIGS. 5 and 6) connected respectively by first and second series of counter-rotating air flow turning vanes 156, 157 which impart swirl to the combustion air passing through the premixer. Thus, the splitter ring 153 defines a first, radially inner passage 116 (with respect to the axis of the center body) with the hub 152 and a second, radially outer passage 118 with the shroud 154, the co-axial passages each having air flow turning, i.e., swirler, vanes 156, 157 which impart swirl to the combustion air passing through the premixer. As illustrated, the vanes 156 of the first passage 116 are connected respectively to the center body or hub 152 and the splitter ring 153 and the vanes 157 of the second passage 118 are connected respectively to the splitter ring 153 and the outer wall or shroud 154. In this embodiment, as in a DACRS swirler, the vanes of the inner and outer arrays are oriented to direct the air flow in respectively opposite circumferential directions, as best seen in the FIG. 6 embodiment. In the embodiments illustrated in FIGS. 4–8, the vanes of the first and second swirler passages are co-extensive in the axial direction.

Figure 4:
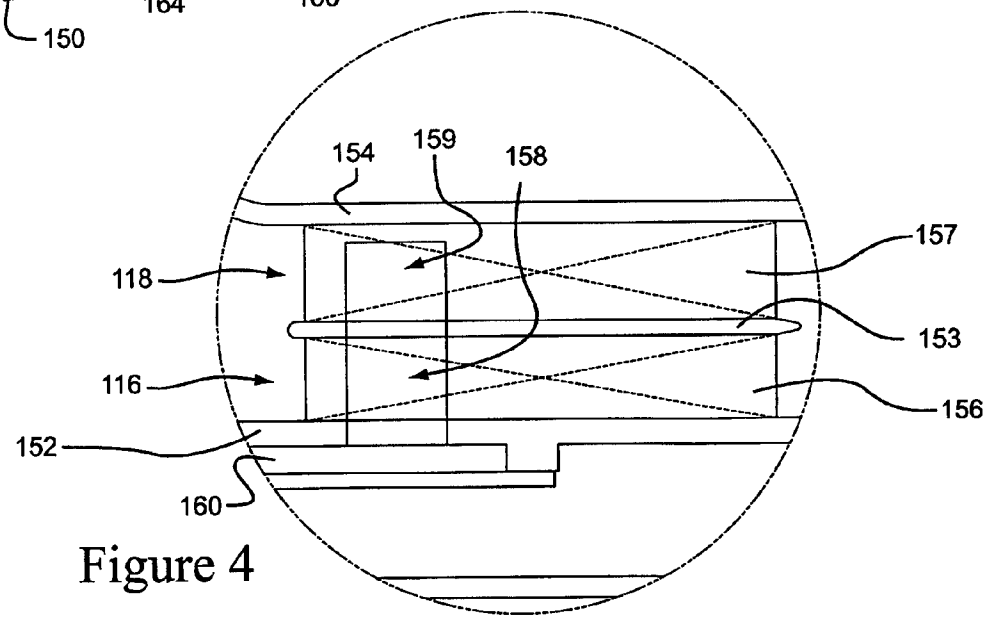
FIG. 4 is a schematic view of the noted portion of FIG. 3.
Figure 5:
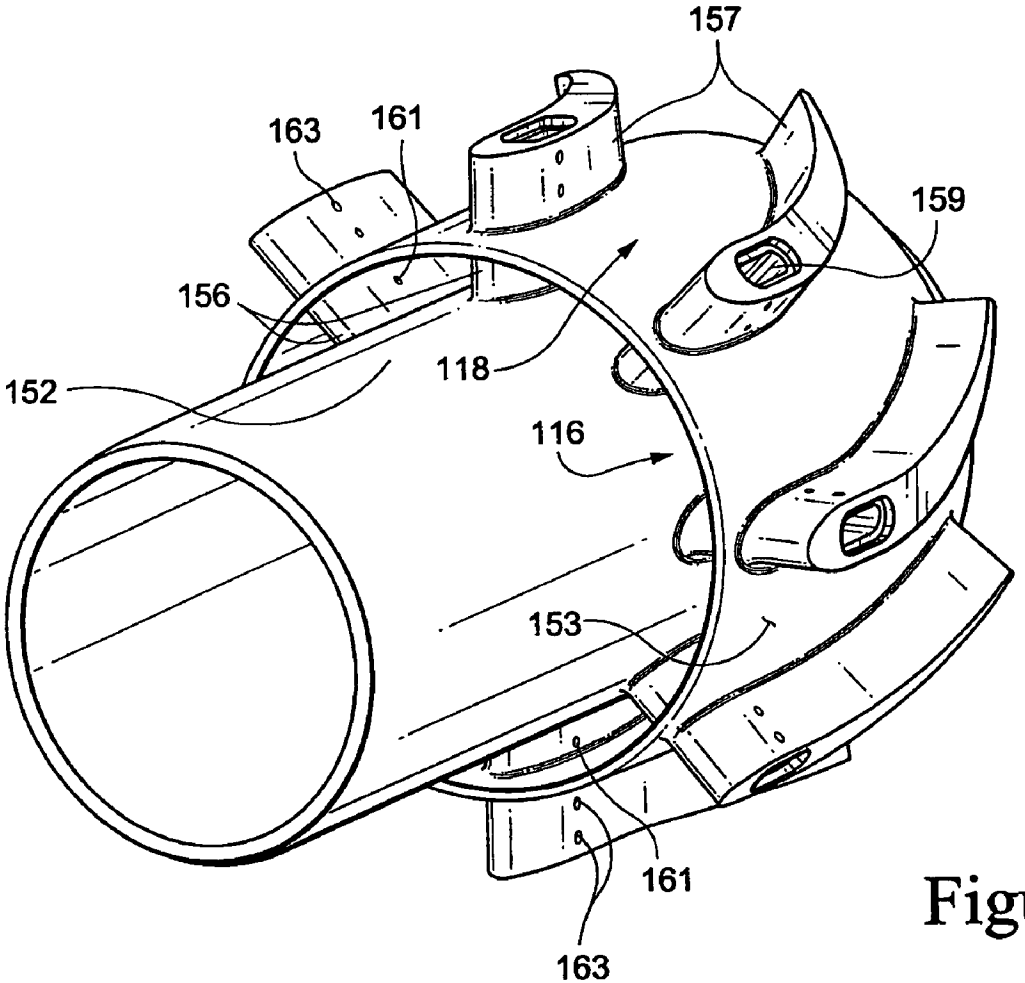
FIG. 5 is a perspective view of a counter rotating vane pack provided as an embodiment of the invention.

In an embodiment of the invention, as depicted for example in FIGS. 3, 4 and 5, fuel is fed to the vanes 156, 157 of both the inner and outer vane passages 116, 118, with the fuel being supplied from the inner diameter via annular fuel passage 160. This is a particularly desirable configuration because the inner diameter support and fuel feed passage 160 are features known from the Swozzle type burner and are standard configuration for mounting burners to an end cover which is required for a can type combustor. Thus, at least some and typically each turning vane contains a gas fuel supply passage 158, 159 through the core of the air foil. The fuel passages distribute gas fuel to at least one gas fuel injection hole 161, 163 (fuel inlet for injecting fuel into air flowing through the swirler vane assembly) defined respectively in the inner and outer arrays of turning vanes. These fuel inlet(s) may be located on the pressure side, the suction side or both sides of the turning vanes as in the illustrated embodiment. Also, the fuel inlet(s) may be located on the inner, outer, or both sets of turning vanes. Other embodiments provide, in addition or in the alternative, fuel injection from fuel inlet(s) in the shroud or hub, so that the turning vane(s) do not have to have fuel passages.

In the embodiment illustrated in FIGS. 3–5, gas fuel enters the swirler assembly through inlet port(s) and annular passage(s) 160, which feed the turning vane passages 158, 159, for flow to the fuel inlet(s) 161, 163. The gas fuel begins mixing with combustion air in the swirler assembly 150, and fuel/air mixing is completed in the annular passage 162, which is formed by a center body extension 164 and a swirler shroud extension 166. After exiting the annular passage, the fuel/air mixture enters the combustor reaction zone where combustion takes place.

According to a further feature of the invention, the trailing edge of the splitter ring or vane 153 is aerodynamically curved, e.g. elliptically configured, as depicted by way of example in the schematic cross-section of FIG. 4. This feature minimizes the wake or aerodynamic separation area behind the ring, an advantageous feature in burners that employ a pre-mixed gas mixture within the burner due to the possibility of a flame stabilizing or holding in the separation zone, which would result in burning of the fuel nozzle itself.

Since the swirler assembly injects gas fuel through the surface of the aerodynamic turning vanes (air foils) the disturbance to the air flow field is minimized. The use of this geometry does not create any regions of flow stagnation or separation/recirculation in the premixer after fuel injection into the air stream. Secondary flows are also minimized with this geometry with the result that control of fuel/air mixing and mixture distribution profile is facilitated. The flow field remains aerodynamically clean from the region of fuel injection to the premixer discharge into the combustor reaction zone. In the reaction zone, the net resultant swirl induced by the dual vane pack causes a central vortex to form with flow recirculation. This stabilizes the flame front in the reaction zone. As long as the velocity in the premixer remains above the turbulent flame propagation speed, flame will not propagate into the premixer (flash back) and with no flow separation or recirculation in the premixer, flame will not anchor in the premixer in the event of a transient causing flow reversal. The ability of the dual vane pack structure to resist flash back and flame holding is important since occurrence of these phenomena causes the premixer to over heat with subsequent damage potential.

The center body of the burner assembly generally corresponds to the structure of the conventional swozzle burner, so that a further discussion is omitted here.

Figure 6:
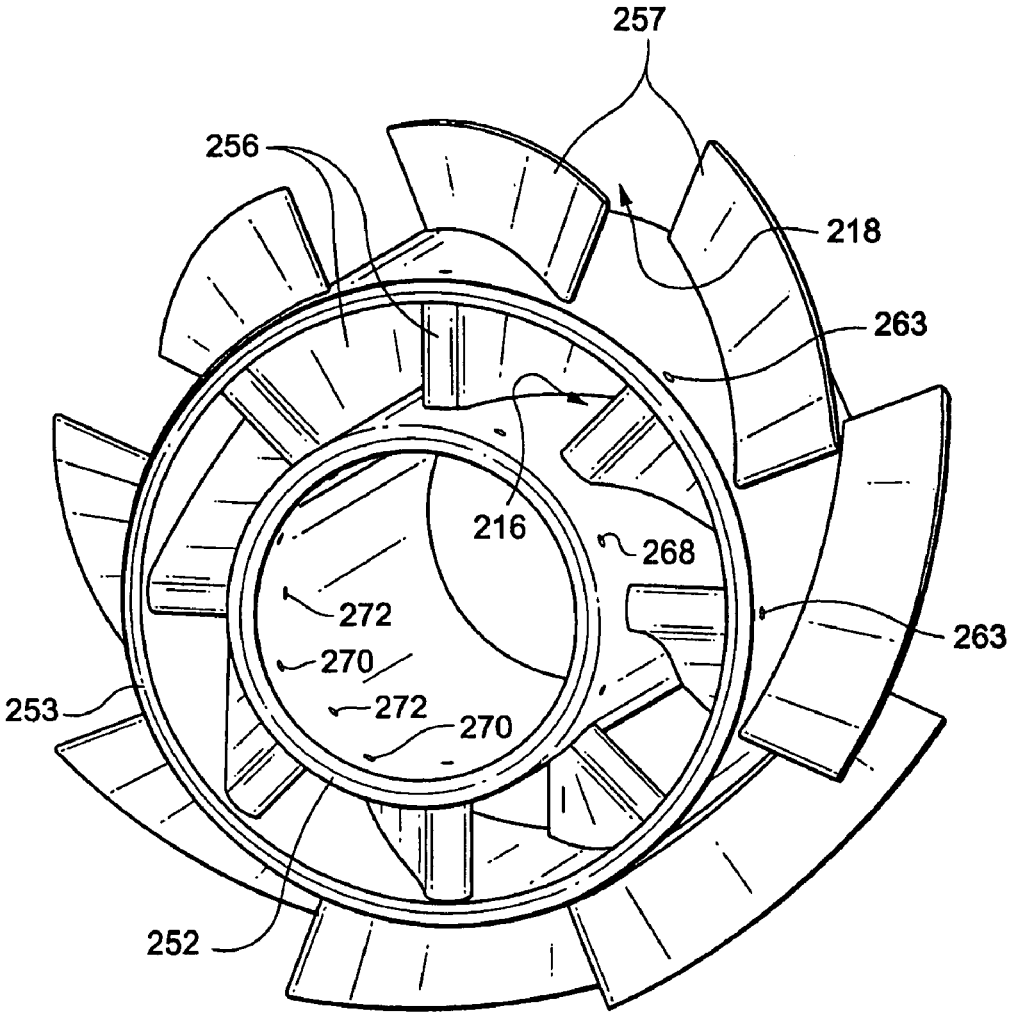
FIG. 6 is a schematic perspective view illustrating a vane pack configuration according to an alternate embodiment of the invention.

An alternate embodiment of the dual vane pack configuration is illustrated by way of example in FIG. 6. This configuration is composed of an inner diameter swirler with sufficient vane thickness to provide a gas passage to the hub or splitter ring of the outer diameters for passage. This further configuration is designed so that it can be produced in a single piece casting. The individual vanes 256, 257 are offset circumferentially by an appropriate angle to allow the ring-strut-ring thermal stress to dissipate through the splitter ring. The vanes in each swirler package may also incorporate a lean or a non-radial orientation which will further reduce the ring-strut-ring stress. The fuel inlet holes 268, 270 in this assembly can be produced using a simple drilling operation due to the radial orientation of the holes. The fuel injection holes (inlets) 268, located on the inner diameter hub 252 may be positioned axially in front of the vanes 256 and splitter ring 253 to allow access for drilling as at 270. Note that alternating holes are drilled through the inner hub for fuel flow to the inner diameter swirler 216 and through the inner hub 252 (as at 272) and inner diameter swirler vanes 256 to the outer diameter hub or splitter ring 253 to define fuel inlet holes 263 for fuel flow to the outer diameter swirler 218. In a typical Swozzle design, the fuel feed passages are produced through a plunge EDM process or a ceramic core in the investment casting, both of which are expensive. Additionally, the fuel injection holes 163 of the FIG. 5 embodiment are typically produced through a plunge EDM through the side of the vanes, which is again very costly. Thus, the embodiment depicted in FIG. 6 is designed for rapid low cost manufacturability.

Figure 7:
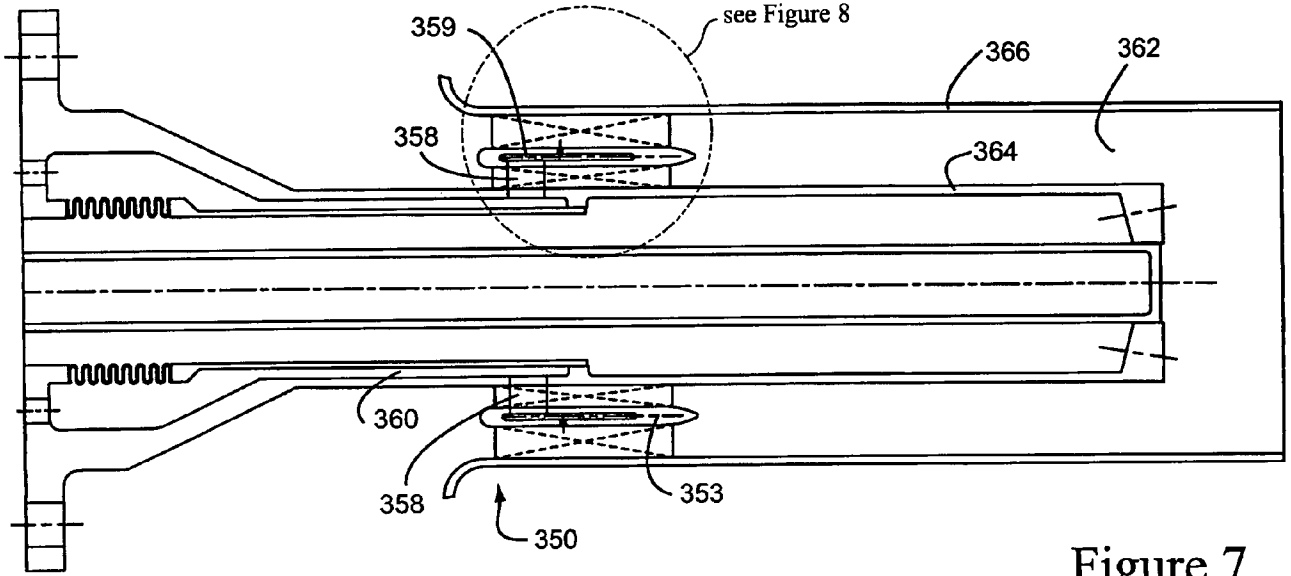
FIG. 7 is a schematic cross-sectional view of a burner according to another embodiment of the invention.
Figure 8:
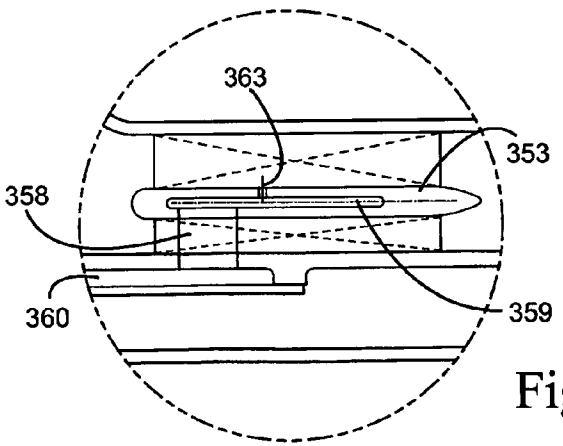
FIG. 8 is a schematic view of the noted portion of FIG. 7.

A further alternate embodiment of the invention is depicted in FIGS. 7 and 8. In this embodiment the fuel gas fuel enters the swirler assembly through inlet port(s) and annular passage(s) 360, which feed a turning vane passage 358, for flow to the hollow interior 359 of the splitter ring 353 and to fuel inlet holes 363 defined in the splitter ring and oriented in a radial direction, perpendicular to the centerline. As in the embodiments described above, the gas fuel begins mixing with combustion air in the swirler assembly 350, and fuel/air mixing is completed in the annular passage 362, which is formed by a center body extension 364 and a swirler shroud extension 366. After exiting the annular passage, the fuel/air mixture enters the combustor reaction zone where combustion takes place. In this embodiment, as in the embodiment of FIG. 4, the trailing edge of the splitter ring or vane 353 is aerodynamically curved, e.g. elliptically configured, to minimize the wake or aerodynamic separation area behind the ring 353.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. Thus, other embodiments are possible that preserve the intent of the invention while differing in subtle ways. One such embodiment achieves high shear between the two swirling streams, and hence strong turbulent mixing, using two swirlers rotating in the same direction relative to the centerbody axis, but at substantially different swirl angles. For instance, an inner swirler with a swirl angle of 20 degrees and outer swirler with swirl angle of 60 degrees may accomplish similar mixing to the preferred embodiment, but result in a higher residual swirl and hence stronger recirculation and flame stabilization in the flame zone. Another alternate embodiment can incorporate more than two swirlers at different swirl angles, for instance, three coaxial swirlers with the inner and outer swirler co-rotating and the middle swirler counter-rotating. In a third possible alternate embodiment, one or more of the swirlers could be flowing predominantly in a radial rather than axial direction, or in a combined radial and axial direction.

What is claimed is:

1. A burner for use in a combustion system of an industrial gas turbine, the burner comprising:

an outer peripheral wall;

a burner center body coaxially disposed within said outer wall;

a fuel/air premixer including an air inlet, at least one fuel inlet, and a splitter ring, the splitter ring defining a first, radially inner passage, with respect to the axis of the center body, with the center body and a second, radially outer passage with the outer wall, the first and second passages each having air flow turning vanes which impart swirl to the combustion air passing through the premixer, said vanes connected respectively to said center body and said splitter ring and to said splitter ring and said outer wall; and a gas fuel flow passage defined within said center body and extending at least part circumferentially thereof, for conducting gas fuel to said fuel/air premixer.

2. A burner according to claim 1, wherein at least some vanes of said radially inner passage comprise an internal fuel flow passage, the gas fuel flow passage introducing fuel into said internal fuel flow passages.

3. A burner according to claim 2, wherein said at least one fuel inlet comprises a plurality of fuel metering holes communicating with the internal fuel flow passages.

4. A burner according to claim 2, wherein there are a plurality of fuel inlets, at least some of which are defined in said vanes having fuel flow passages.

5. A burner according to claim 2, wherein said splitter ring defines a hollow interior fuel cavity and wherein said at least fuel inlet is defined in said splitter ring, in communication with said hollow cavity.

6. A burner according to claim 1, wherein the trailing edge of the splitter ring is aerodynamically curved to minimize a wake or aerodynamic separation area behind the ring.

7. A burner according to claim 1, further comprising an annular mixing passage downstream of the turning vanes, defined between said outer wall and said center body.

8. A burner according to claim 1, wherein said outer wall extends generally in parallel to said center body.

9. A burner according to claim 7, wherein said outer wall extends generally in parallel to said center body and in parallel to said axis of said center body, so that said mixing passage has a substantially constant inner and outer diameter along the length of the center body.

10. A burner according to claim 1, wherein a downstream end of said center body provides a bluff body to which the flame anchors.

11. A burner according to claim 1, wherein the outer passage swirl direction is counter-rotating relative to the inner passage swirl direction.

12. A burner for use in a combustion system of an industrial gas turbine, the burner comprising:

an outer peripheral wall;

a burner center body coaxially disposed within said outer wall;

a fuel/air premixer including an air inlet, at least one fuel inlet, and a splitter ring, the splitter ring defining a first, radially inner passage, with respect to the axis of the center body, with the center body and a second, radially outer passage with the outer wall, the first and second passages each having air flow turning vanes which impart swirl to the combustion air passing through the premixer, said vanes connected respectively to said center body and said splitter ring and to said splitter ring and said outer wall;

an annular mixing passage defined between said outer wall and said center body, downstream of the turning vanes, said outer wall extending generally in parallel to said center body and in parallel to said axis of said center body, so that said mixing passage has a substantially constant inner and outer diameter along the length of the center body.

13. A burner according to claim 12, wherein a downstream end of said center body provides a bluff body to which the flame anchors.

14. A burner according to claim 12, wherein at least some vanes of said radially inner passage comprise an internal fuel flow passage, the fuel inlet introducing fuel into said internal fuel flow passages.

15. A burner according to claim 14, wherein said at least one fuel inlet comprises a plurality of fuel metering holes communicating with the internal fuel flow passages.

16. A burner according to claim 14, wherein there are a plurality of fuel inlets, at least some of which are defined in said vanes having fuel flow passages.

17. A burner according to claim 12, wherein said splitter ring defines a hollow interior fuel cavity and wherein said at least fuel inlet is defined in said splitter ring, in communication with said hollow cavity.

18. A burner according to claim 12, wherein the trailing edge of the splitter ring is aerodynamically curved to minimize a wake or aerodynamic separation area behind the ring.

19. A burner according to claim 12, wherein the outer passage swirl direction is counter-rotating relative to the inner passage swirl direction.

20. A method of premixing fuel and air in a burner for a combustion system of a gas turbine, the burner including an outer peripheral wall; a burner center body coaxially disposed within said outer wall; a fuel/air premixer including an air inlet, at least one fuel inlet, and a splitter ring, the splitter ring defining a first, radially inner passage, with respect to the axis of the center body, with the center body and a second, radially outer passage with the outer wall, the first and second passages each having air flow turning vanes which impart swirl to the combustion air passing through the premixer, said vanes connected respectively to said center body and said splitter ring and to said splitter ring and said outer wall, at least some of said vanes comprising an internal fuel flow passage, the fuel inlet introducing fuel into said internal fuel flow passages; and a gas fuel flow passage defined within said center body and extending at least part circumferentially thereof, for conducting gas fuel to said fuel/air premixer; the method comprising:

(a) controlling a radial and circumferential distribution of incoming air upstream of the fuel inlet;

(b) flowing said incoming air into said first and second passages of said swirler assembly;

(b) imparting swirl to the incoming air with said turning vanes; and (c) mixing fuel and air into a uniform mixture downstream of said turning vanes, for injection into a combustor reaction zone of the burner.

21. A method according to claim 20, wherein the outer passage swirl direction is counter-rotating relative to the inner passage swirl direction.

22. A burner according to claim 12, wherein said at least one fuel inlet comprises a plurality of fuel metering holes for directing fuel in a direction substantially perpendicular to an air flow direction through the premixer.

* * * * *